US008580041B2

(12) United States Patent
Schafer et al.

(10) Patent No.: US 8,580,041 B2
(45) Date of Patent: Nov. 12, 2013

(54) PROCESS FOR CLEANING RESIN OUT OF AN ELECTRICAL GENERATOR PARALLEL RING

(75) Inventors: Bruce William Schafer, Lynchburg, VA (US); Joseph Anthony Crockett, Forest, VA (US)

(73) Assignee: Areva NP Inc, Lynchburg, VA (US)

( * ) Notice: Subject to any disclaimer, the term of this patent is extended or adjusted under 35 U.S.C. 154(b) by 747 days.

(21) Appl. No.: 12/702,130

(22) Filed: Feb. 8, 2010

(65) Prior Publication Data

US 2010/0326474 A1 Dec. 30, 2010

Related U.S. Application Data

(60) Provisional application No. 61/269,804, filed on Jun. 29, 2009.

(51) Int. Cl.
*B08B 9/04* (2006.01)

(52) U.S. Cl.
USPC ..... 134/8; 134/42

(58) Field of Classification Search
USPC ..... 134/8, 22.1, 22.11, 22.12, 42; 15/104.09, 104.095, 104.03, 104.02, 15/104.05
See application file for complete search history.

(56) References Cited

U.S. PATENT DOCUMENTS 4,687,522 A * 8/1987 Hayashi et al. ..... 134/8
4,792,363 A * 12/1988 Franklin et al. ..... 134/8
6,648,633 B1 * 11/2003 Suchan et al. ..... 432/75

* cited by examiner

*Primary Examiner* — Saeed T Chaudhry
(74) *Attorney, Agent, or Firm* — Davidson, Davidson & Kappel, LLC

(57) ABSTRACT

A process of cleaning resin out of an electrical generator parallel ring is provided. The process includes inserting a cleaning ball mounted on a shaft into the parallel ring; verifying a location of the cleaning ball; rotating the shaft; measuring a rotational speed of the cleaning ball with a tachometer; and removing resin with the cleaning ball.

11 Claims, 2 Drawing Sheets

PROCESS FOR CLEANING RESIN OUT OF AN ELECTRICAL GENERATOR PARALLEL RING

Priority to U.S. Provisional Patent Application Ser. No. 61/269,804 filed Jun. 29, 2009, is claimed, the entire disclosure of which is hereby incorporated by reference.

The present invention relates generally to an apparatus and method for cleaning electrical generator parallel rings.

BACKGROUND

Electrical generator parallel rings are used to remove power from an electrical generator during power plant operation. They are manufactured from copper pipe. During fabrication of the electrical generator parallel rings at a manufacturers facility, resin, used in another part of the fabrication process, may be accidentally introduced to the inside of the parallel ring piping. During fabrication the resin flows around the inside of the pipe to low points of the system and creates blockages within the pipes. Hydrogen flows to provide cooling, at relatively low pressure, through the inside of these pipes. The flow of hydrogen, pipe vibration or some other means may cause the resin to become dislodged and block the hydrogen flow path, resulting in overheating of the parallel ring pipes. Overheating of the pipes in the parallel ring could also lead to changes in electrical resistance which can create electrical issues with the generator.

Parallel rings are typically fabricated from approximately 2.25 in. OD×0.500 in. wall copper piping. Six pipes may comprise the parallel ring assembly and each of the pipes typically has a total arc length of approximately 90 degrees. Each of these pipes may have two inlets, one on each end of each pipe, and one exit point, in the middle of the pipe.

Due to the orientation of the ends of the pipes, with multiple 90° bends along their length, it is not possible to use standard pipe cleaning tooling to remove the resin. In addition, resin removal may be required in the 90° bends. Standard tooling used to clean straight, or slightly curved sections of pipe include brushes, scrapers, cone cutters, flexible hones, and flare brushes. These tools can be purchased from companies such as Goodway Technologies. Inside diameter tooling may also be used to cut heat exchanger tubes. These tools have been used in tubes from ⅝" to 1" diameter and are all driven by the same high speed motor that is used for resin removal while the cutting tip rotational speed is monitored with a tachometer.

None of the standard pipe cleaning tools mentioned above are flexible enough to negotiate the tight bends of parallel rings. In addition, most of these tools are used at relatively low speeds (approximately 2000-3000 RPM). Due to the thickness and adhesion of some of the resin deposited in parallel rings, tools spinning at this relatively low speed may not effectively remove the resin. Further, some of these tools may damage the inside surface of the parallel ring piping due to their aggressive design.

SUMMARY OF THE INVENTION

An object of the present invention is to effectively clean resin from the inside of the parallel ring piping, while minimizing outage time. The present invention provides a cleaning system and method flexible enough to reach all areas of the pipe without disassembly of the parallel ring. The present invention provides a resin removal tooling system for electric generator parallel rings comprising: a non-rotating sheath; a rotating shaft mounted in the non-rotating sheath; a cleaning ball attached to the rotating shaft, the non-rotating sheath positioning the cleaning ball; a high speed motor coupled to the shaft to rotate the shaft; a variable power supply connected to the high speed motor; and a tachometer for measuring a rotational speed of the high speed motor and the cleaning ball.

Another object of the invention is to provide a process of cleaning resin out of an electrical generator parallel ring comprising the following steps: inserting a cleaning ball mounted on a shaft into the parallel ring; verifying the location of the cleaning ball; rotating the shaft; measuring a rotational speed of the cleaning ball with a tachometer; and removing resin with the cleaning ball.

BRIEF DESCRIPTION OF THE DRAWINGS

The present invention will be described further with respect to one embodiment using the figures, in which.

DETAILED DESCRIPTION

Figure 1:
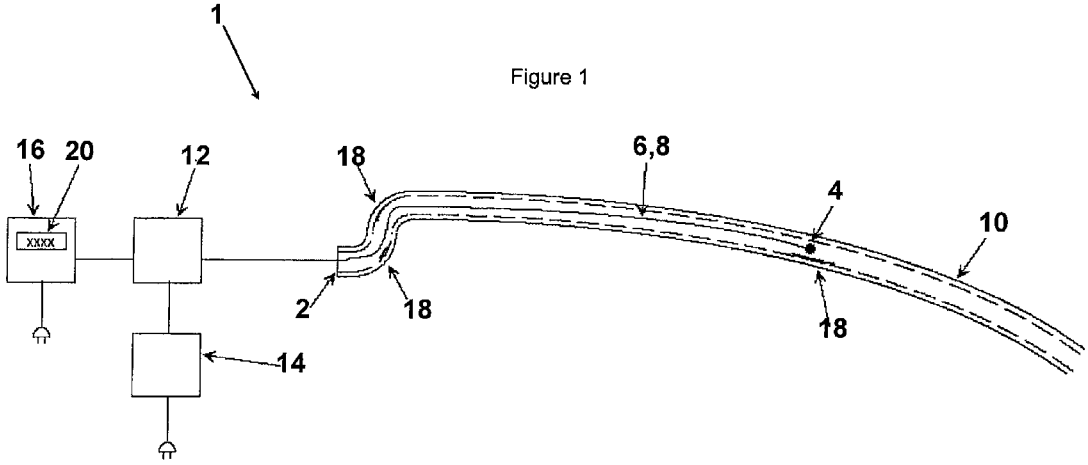
FIG. 1 shows a schematic of the parallel ring piping resin removal system.

FIG. 1 shows a schematic of a parallel ring piping resin removal system 1 for cleaning resin 18 out of a parallel ring pipe 10. System 1 consists of a cleaning ball 4 connected to a rotating shaft 6. Rotating shaft 6 is placed inside a non-rotating sheath 8. Non-rotating sheath 8 is used to position ball 4 to the appropriate location inside parallel ring pipe 10. Non-rotating sheath 8 may be easily held in position by a tooling operator. Parallel piping ring 10 has two ends with openings. All cleaning equipment, cleaning ball 4, rotating shaft 6, and non-rotating sheath 8, is placed into parallel ring pipe 10 through an opening 2 at one of the ends of pipe 10.

The end of rotating shaft 6 and non-rotating sheath 8, opposite cleaning ball 4, is connected to a high speed motor 12 used to spin rotating shaft 6. High speed motor 12 is connected to a variable power supply 14 and to a tachometer box 16. Tachometer box 16 is used to measure a rotational speed of the high speed motor 12 and cleaning ball 4. The speed is controlled by varying the voltage of variable power supply 14 which is supplied to the high speed motor 12.

The resin removal process is controlled by inserting cleaning ball 4 into pipe 10 where resin 18 is located. The location of cleaning ball 4 is verified either through the use of a videoprobe or a preset dimension. After the proper position is attained for cleaning ball 4, high speed motor 12 is turned on while the speed of high speed motor 12 is monitored on a display 20. The voltage of the variable power supply 14 is adjusted until a proper cleaning speed is reached. Proper cleaning speed is based on the thickness of the copper piping that is used in the construction of parallel ring 10, the design and size of the cleaning ball 4 and the consistency of the resin 18. By varying the rotation speed of the cleaning tip different vibration modes can be achieved to change the rate that cleaning ball 4 impacts the inside surface of the pipe 10 and resin 18.

The resin removal process is run for either a predetermined period of time or based on visual feedback from a videoprobe that is inserted into pipe 10 from the opposite end of where cleaning ball 4, rotating shaft 6 and non-rotating sheath 8 are located. Cleaning continues on all areas that have resin 18 until resin 18 is visually verified as removed. Either during or after cleaning is complete, a vacuum cleaner is mounted on either end opening 2 of parallel ring piping 10 to vacuum out any debris that was generated during cleaning.

Figure 2:
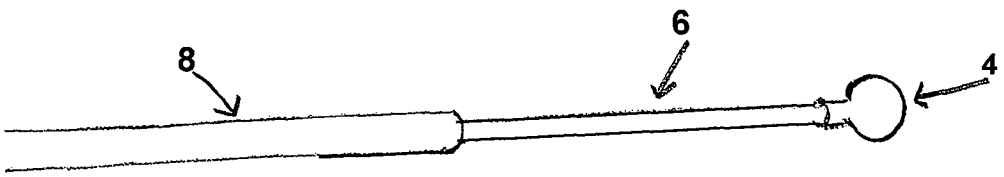
FIG. 2 shows the working end of the cleaning tip.

FIG. 2 shows the working end of the cleaning tip showing a non-rotating sheath 8 surrounding rotating shaft 6. At the end of cleaning ball 4 is rotating shaft 6.

The speed and size of the cleaning ball 4 is selected to be great enough that removal of resin 18 from the inside portion of the pipe 10 is possible. Cleaning ball 4 is designed to be effective in cleaning the pipe surface without damaging the copper pipe. Cleaning ball 4 is designed to remove resin by a peening action rather than acting as a cutting tip. As cleaning ball 4 flails around inside the pipe, it impacts resin 18, breaking it free from the pipe surface and allowing it to be vacuumed out of the pipe 10.

Cleaning ball 4, rotating shaft 6, and non-rotating sheath 8 are sized to allow access to all portions of the parallel ring pipe without removal of the elbows on the ends of the pipe. Cleaning ball 4, rotating shaft 6, and non-rotating sheath 8 can also be inserted through small diameter orifices that are placed over the ends of the parallel ring pipes after electrical generator final assembly. Resin removal can be performed in all areas, including the elbows, using the present resin removal tooling, cleaning ball 4, rotating shaft 6, and non-rotating sheath 8, where other cleaning tooling will not work in the tight radius bends.

The process and system described above is not limited to parallel ring piping or resin removal. This system disclosed can be used anywhere tight bends or other restrictions limit the insertion or use of standard pipe cleaning tooling. The system disclosed can be used on differing pipe sizes and materials. The process disclosed can be used to clean other types of deposits besides resin. In addition, different cleaning tip designs such as cylindrical, pointed or round with an offset configuration may be used in lieu of the cleaning ball disclosed depending on the cleaning situation.

In the preceding specification, the invention has been described with reference to specific exemplary embodiments and examples thereof. It will, however, be evident that various modifications and changes may be made thereto without departing from the broader spirit and scope of the invention as set forth in the claims that follow. The specification and drawings are accordingly to be regarded in an illustrative manner rather than a restrictive sense.

What is claimed is:

1. A process of cleaning resin out of an electrical generator parallel ring comprising the following steps:

inserting a cleaning ball mounted on a bendable shaft into the parallel ring such that the cleaning ball passes around at least one 90 degree bend in the parallel ring;

verifying a location of the cleaning ball;

rotating the bendable shaft;

measuring a rotational speed of the cleaning ball with a tachometer; and removing resin with the cleaning ball by impacting a peening action on the resin with the cleaning ball.

2. The process as recited in claim 1 further comprising verifying all resin is removed.

3. The process as recited in claim 1 further comprising vacuuming resin debris out of the parallel ring.

4. The process as recited in claim 1 further comprising varying the rotating speed.

5. The process as recited in claim 1 wherein the process is run for a predetermined period of time.

6. The process as recited in claim 1 wherein the process is run based on virtual feedback from a videoprobe inserted in the pipe.

7. The process as recited in claim 1 wherein the inserted ball accesses all portions of the parallel ring without removing portions of the parallel ring.

8. The process as recited in claim 1 wherein the removing resin with the cleaning ball includes removing resin from the at least one bend.

9. The process as recited in claim 8 wherein the removing resin with the cleaning ball includes removing resin from the parallel ring at the 90 degree bend.

10. The process as recited in claim 1 wherein the bendable shaft is inside a bendable sheath, the inserting the cleaning ball into the parallel ring including inserting the bendable shaft and bendable sheath into the parallel ring such that the bendable shaft and bendable sheath bend.

11. The process as recited in claim 10 wherein the rotating the bendable shaft includes rotating the bendable shaft inside of the bendable sheath without rotating the bendable sheath.

* * * * *